US007849569B2

(12) United States Patent
Cope

(10) Patent No.: US 7,849,569 B2
(45) Date of Patent: Dec. 14, 2010

(54) MAGNETIC BRACELET HOOD CLASP

(75) Inventor: Steven Cope, Cincinnati, OH (US)

(73) Assignee: I.B. Goodman Mfg. Company, Inc., Newport, KY (US)

( * ) Notice: Subject to any disclaimer, the term of this patent is extended or adjusted under 35 U.S.C. 154(b) by 159 days.

(21) Appl. No.: 12/053,018

(22) Filed: Mar. 21, 2008

(65) Prior Publication Data

US 2009/0106950 A1 Apr. 30, 2009

Related U.S. Application Data

(60) Provisional application No. 60/919,231, filed on Mar. 21, 2007.

(51) Int. Cl.
*A44B 11/25* (2006.01)

(52) U.S. Cl. ..... 24/303; 63/3.1

(58) Field of Classification Search ..... 24/303, 24/265 BC, 578.13, 580.11, 595.1; 63/3.1, 63/3, 33, 900; 70/276, 413; 292/251.5
See application file for complete search history.

(56) References Cited

U.S. PATENT DOCUMENTS

| | | | | |
|---|---|---|---|---|
| 2,654,929 | A * | 10/1953 | Feibelman | 24/303 |
| 3,201,842 | A * | 8/1965 | Armistead | 24/303 |
| 3,372,500 | A * | 3/1968 | Claude | 40/633 |
| 4,527,311 | A | 7/1985 | Aoki | |
| 4,989,299 | A * | 2/1991 | Morita | 24/303 |
| 5,664,298 | A * | 9/1997 | Nessar-Ivanovic | 24/303 |
| 5,722,260 | A * | 3/1998 | Mangano | 63/3.1 |
| 5,996,831 | A * | 12/1999 | Teok | 220/230 |
| 6,470,708 | B1 * | 10/2002 | Green | 63/3.2 |
| 6,698,070 | B2 * | 3/2004 | Chen | 24/303 |
| 6,711,788 | B1 * | 3/2004 | Chen | 24/181 |
| 6,729,159 | B2 * | 5/2004 | Rose | 63/29.1 |
| 6,804,865 | B2 * | 10/2004 | Grunberger et al. | 24/303 |
| 6,857,169 | B2 * | 2/2005 | Chung | 24/303 |
| 6,892,428 | B2 * | 5/2005 | Reiter | 24/303 |
| 7,073,232 | B1 | 7/2006 | Fuhrman et al. | |
| 7,207,091 | B2 * | 4/2007 | Dunaye | 24/303 |
| 7,334,433 | B1 * | 2/2008 | Fuhrman et al. | 63/3.1 |
| 7,377,128 | B1 * | 5/2008 | Zucker-Pinchoff | 63/3.1 |
| 2003/0061689 | A1 | 4/2003 | Fuhrman | |
| 2005/0178154 | A1 * | 8/2005 | Horan | 63/3.1 |
| 2005/0283953 | A1 * | 12/2005 | Jeffrey | 24/303 |
| 2007/0033775 | A1 * | 2/2007 | Hsiao | 24/303 |

OTHER PUBLICATIONS

International Search Report dated Jan. 26, 2009 for Application No. PCT/US2008/057822.
Written Opinion dated Jan. 26, 2009 for Application No. PCT/US2008/057822.

* cited by examiner

*Primary Examiner*—Robert J Sandy
*Assistant Examiner*—Rowland D Do
(74) *Attorney, Agent, or Firm*—Frost Brown Todd LLC

(57) ABSTRACT

A clasp for an ornamental object comprising a base, a top, and a link. The link engages the base. The engagement occurs where at least one projection and an aperture from the link respectively engage at least one cavity and a post from the base. The engagement between the base and top is further secured by moving the top and the base proximal each other such that the link is positioned between the two. Magnetic force is used to position the top and base proximal each other.

18 Claims, 13 Drawing Sheets

MAGNETIC BRACELET HOOD CLASP

This application claims priority from U.S. Provisional Patent Application Ser. No. 60/919,231, filed Mar. 21, 2007, titled Magnetic Bracelet Hood Clasp, the disclosure of which is incorporated herein by reference.

BACKGROUND OF THE INVENTION

This application relates generally to ornamental objects and clasps for such objects.

BRIEF SUMMARY

A clasp comprises a base comprising a receiving end and an end opposite the receiving end, wherein a first magnet holder, a post, and at least one cavity are positioned between the receiving end and the opposite end; a top comprising an end position adjacent to the base, an end opposite the base, and a second magnet holder positioned between the adjacent end and the opposite end, wherein the second magnet holder may be proximal the first magnet holder when the top and the base are proximal and wherein the base and top are hingedly connected; a link comprising at least one projection and an aperture adjacent the projections, wherein the at least one projection is capable of engaging the at least one cavity, wherein the aperture is capable of engaging the post; and a plurality of magnets respectively positioned in the first magnet holder and the second magnet holder.

BRIEF DESCRIPTION OF THE DRAWING

The accompanying drawings, which are incorporated in and constitute a part of this specification, illustrate embodiments of the application, and, together with the detailed description of the embodiments given below, serve to explain the principles of the present application.

DETAILED DESCRIPTION

Figure 1:
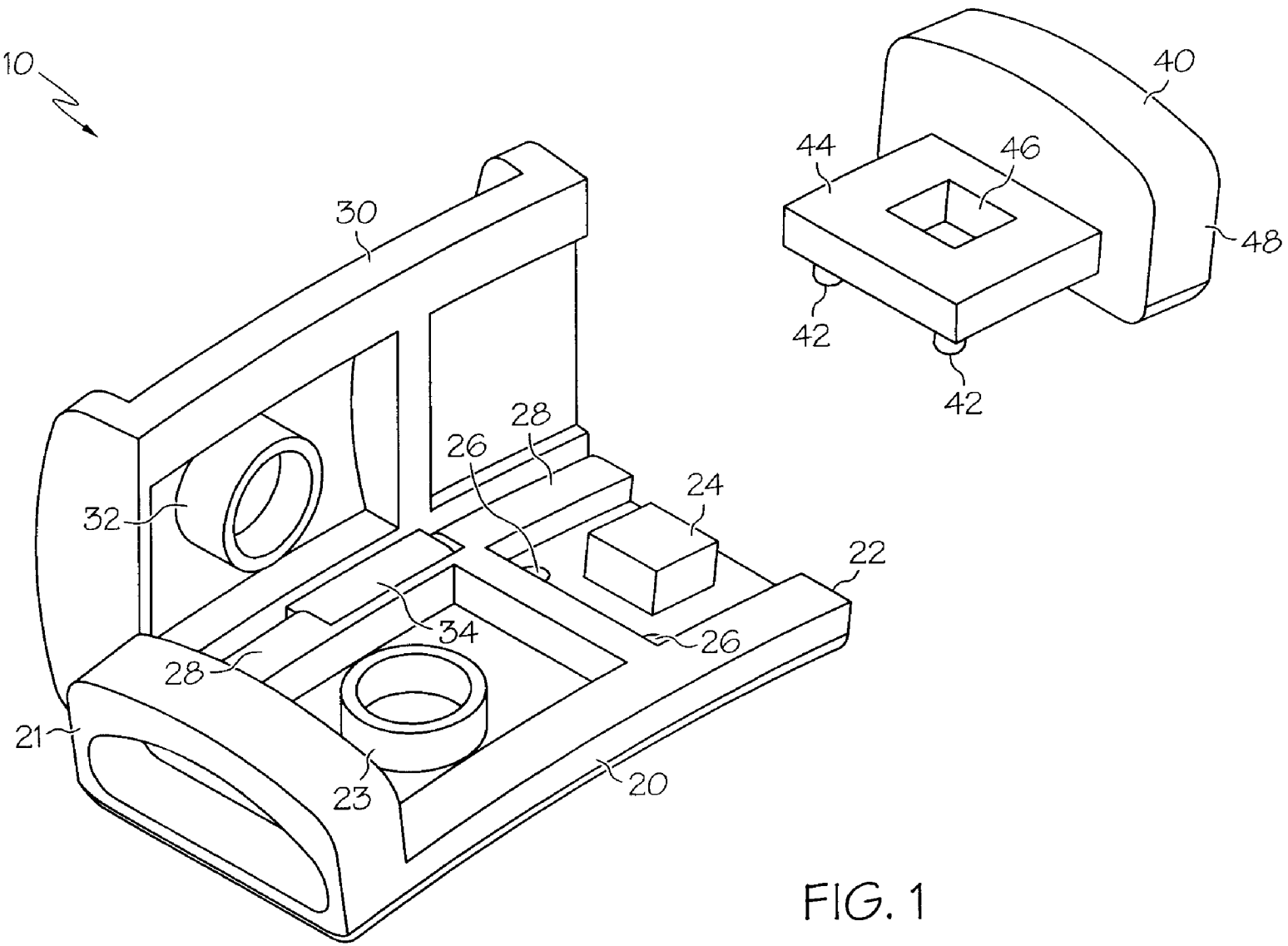
FIG. 1 depicts a perspective view of an exemplary embodiment of a clasp device.

In the following description, like reference characters designate like or corresponding parts throughout the several views. Also, in the following description, it is to be understood that terms such as front, back, inside, outside, and the like are words of convenience and are not to be construed as limiting terms. Terminology used in this patent is not meant to be limiting insofar as devices described herein, or portions thereof, may be attached or utilized in other orientations. Referring in more detail to the drawings, embodiments of the application will now be described.

FIG. 1 depicts an exemplary embodiment of a clasp device 10. As depicted in FIG. 1, clasp device 10 includes a base 20, a top 30, and a link 40. Any suitable base, top, and link may be used. Base 20 and link 40 may support at least one end of an ornamental object including a bracelet or pendant, or any other suitable object. In the example depicted, engaging base 20 and link 40 indirectly connects a plurality of ends of an ornamental object, or any other suitable object. The engagement between base 20 and link 40 may be further secured by positioning top 30 and base 20 proximal each other. Any suitable method or device may be used to position top 30 and base 20 proximal each other. For example, magnetic force may be used.

Figure 2:
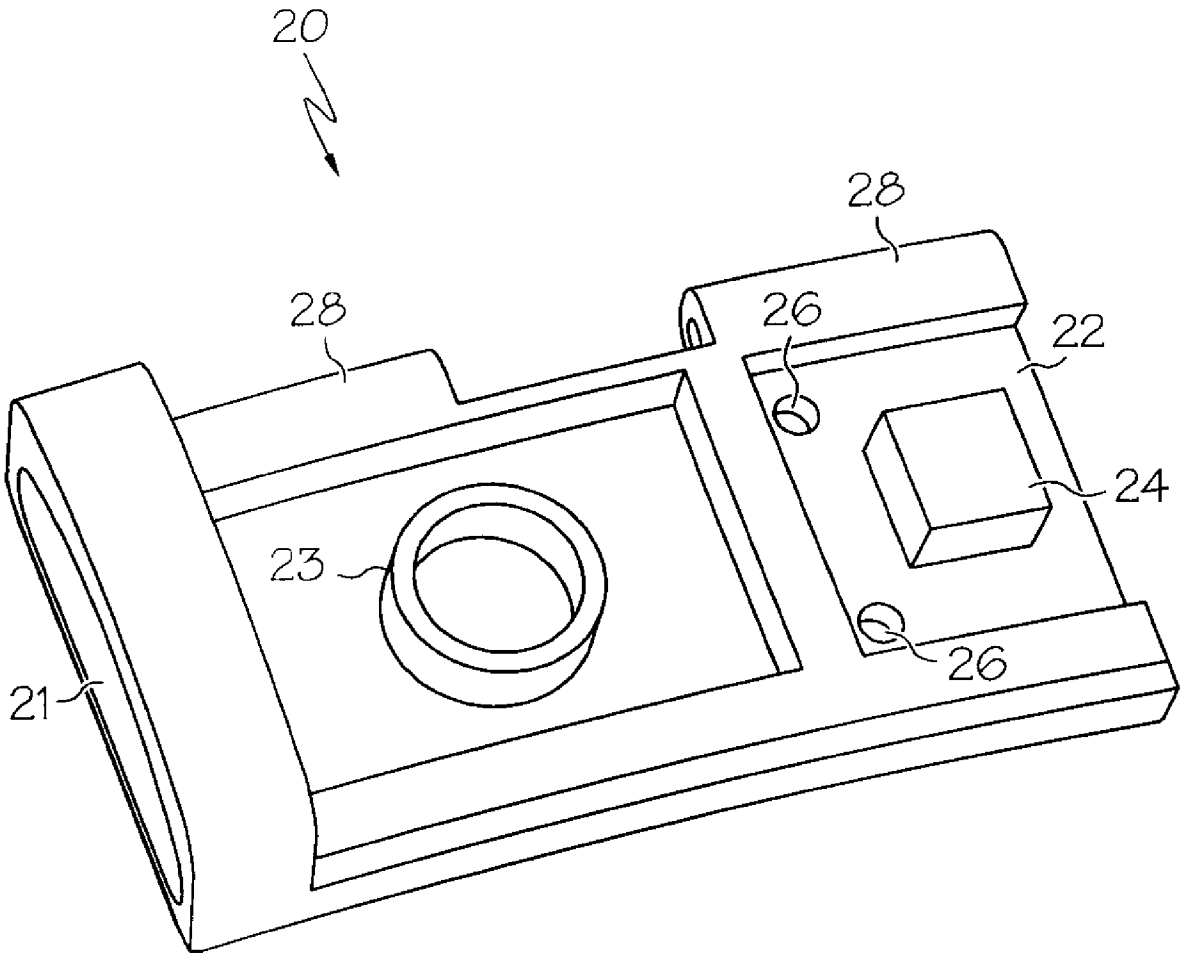
FIG. 2 depicts a perspective view of the base of the device of FIG. 1.

As depicted in FIG. 2, base 20 includes a receiving end 21 and an opposite end 22. Receiving end 21 may receive at least one end of an ornamental object or any other suitable object. A magnet holder 23 is positioned between the receiving end 21 and end 22. Any suitable magnet holder may be used. As depicted in FIG. 2, magnet holder 23 has a cylinder shape.

As further depicted in FIG. 2, a post 24 and a plurality of cavities 26 are positioned between receiving end 21 and opposite end 22. Post 24 and cavities 26 may removably engage link 40. Any suitable post and cavity may be used. In the example depicted, post 24 has a rectangular shape. Yet further depicted, cavities 26 have a cylinder shape. Cavities 26 are positioned adjacent a side of post 24 nearest receiving end 21. However, any suitable position for the cavities may be used. In the example shown, cavities 26 are symmetrically positioned between receiving end 21 and post 24.

Base 20 includes at least one engagement member 28. Engagement member 28 may facilitate the engagement of base 20 and top 30. Any suitable engagement member may be used. As depicted in FIG. 2, engagement member 28 is an elongated cylinder shape capable of supporting a hinge pin. In the example shown, engagement member 28 facilitates using a hinge pin to align at least one respective edge of base 20 and top 30 proximal each other.

Figure 3:
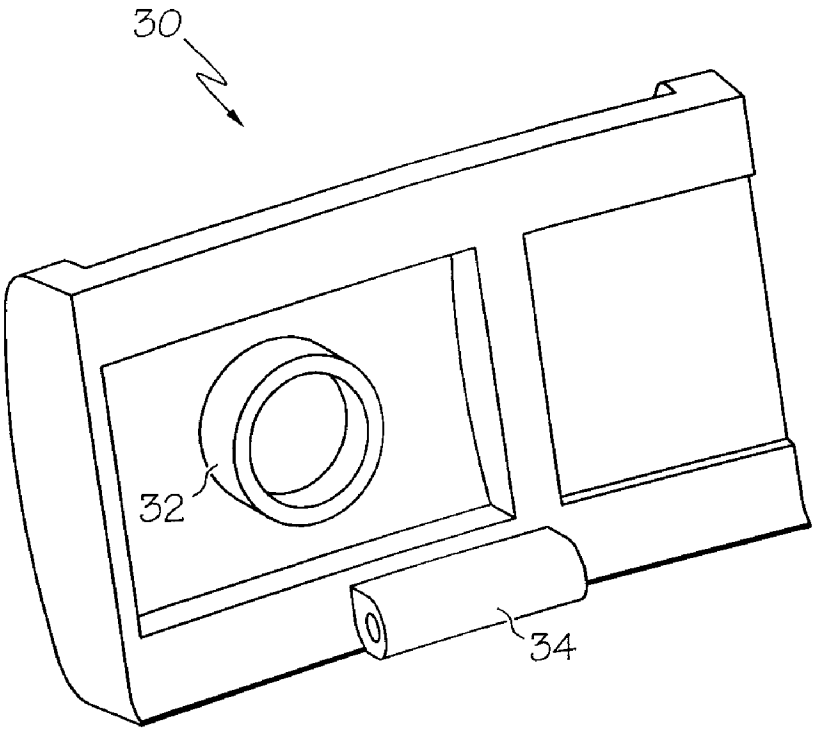
FIG. 3 depicts a perspective view of the top of the device of FIG. 1.

As depicted in FIG. 3, top 30 includes a magnet holder 32 and an engagement member 34. Any suitable magnet holder may be used. In the example shown, magnet holder 32 is positioned to move proximal to magnet holder 23 when base 20 and top 30 are proximal. Moving the magnets in magnet holders 23 and 32 proximal one another will produce a magnetic force. This magnetic force will secure the position of base 20 and top 30 proximal each other and therefore secure the engagement of base 20 and link 40 as link 40.

Engagement member 34 may facilitate the engagement of base 20 and top 30. Any suitable engagement member may be used. Engagement member 34 may rest along an edge of top 30. Top 30 may be removably positioned adjacent the edge of base 20 comprising engagement member 28. Engagement member 34 may be similar, identical, or different compared to engagement member 28. In the example depicted in FIG. 3, engagement member 34 is an elongated cylinder capable of aligning with engagement members 28. A hinge pin (not shown) may extend through members 28, 34. As described in this example, the hinge connection may permit rotational movement of base 20 and top 30 relative to each other.

Figure 4:
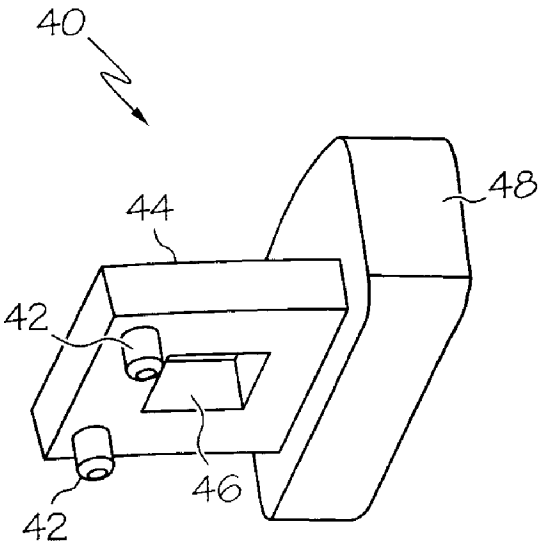
FIG. 4 depicts a perspective view of the link of the device of FIG. 1.

As depicted in FIG. 4, link 40 includes a plurality of projections 42. Projections 42 engage cavities 26 of base 20. Any suitable projection may be used. For example, and as depicted in FIG. 4, projection 42 is a pin. In the example depicted, the pins have a diameter ranging between 0.042 inches and 0.052 inches, and a length of 0.05 inches to 0.06 inches.

As shown in FIG. 4, plate 44 supports projections 42. Plate 44 includes an aperture 46, and is supported by a support member 48. However, any suitable plate may be used. For example, and as depicted in FIG. 4, plate 44 has a rectangular shape having a rectangular aperture 46. In this example, the size and shape of aperture 46 corresponds to the size and shape of post 24. Engaging base 20 and link 40 may be accomplished by respectively engaging post 24 and cavities 26 with aperture 46 and projections 42. In alternate examples not shown, projections 42, plate 44, and support member 48 may comprise a single object. Top 30 may further secure the engagement between base 20 and link 40. Upon engaging base 20 and link 40, top 30 may be positioned proximal base 20.

Figure 5:
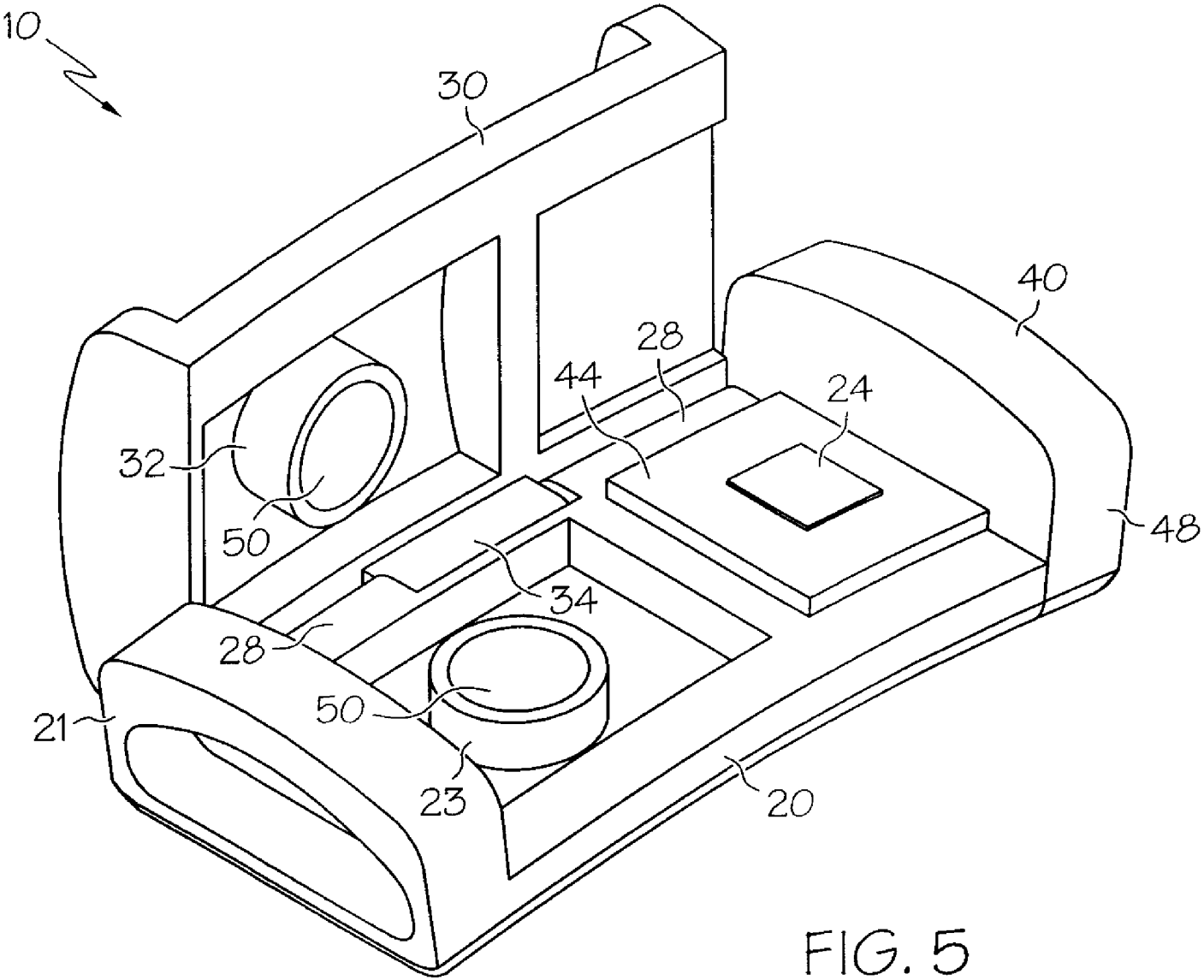
FIG. 5 depicts a perspective view of the device of FIG. 1 in a semi-open position.

FIG. 5 illustrates device 10 in a semi-open position where link 40 is engaged with base 20. In the example shown, base 20 is not proximal to top 30. As depicted in FIG. 5, link 40 is engaged with base 20 because projections 42 have respectively entered cavities 26, and aperture 46 at least partially surrounds post 24. Any suitable method may be used to produce this engagement. For example, link 40 may slide over opposite end 22 towards post 24. After advancing partially past post 24, link 40 may engage base 20 by having projections 42 and aperture 46 respectively align with and engage cavities 26 and post 24.

As mentioned earlier, in this example shown by FIG. 5, projections 42 are pins having a diameter ranging between 0.042 inches to 0.052 inches, and a length ranging between 0.05 inches to 0.06 inches. Cavities 26 in this example have diameters around 0.002 inches larger than the diameter of projection 42, and lengths around 0.005 inches longer than projection 42. As shown in FIG. 5, the pins engage respective cavities 26. The engagement between the pins and cavities 26 protects against base 20 and top 30 moving distal each other by having base 20 and link 40 undesirably disengage each other. Different forces acting on device 10 could cause the undesired disengagement of base 20 and link 40. These forces on device 10 may include those causing base 20 or link 40 to respectively twist, turn, or otherwise move in a direction opposite to the engagement between base 20 and link 40. The engagement between post 24 and aperture 46 protects against base 20 and top 30 undesirably moving distal each other, for example, when base 20 and link 40 undesirably disengage each other. The size of post 24 depicted in FIG. 5 is about 0.120 inches wide and about 0.06 inches tall. The respective aperture 46 is about 0.01 inches to 0.015 inches wider than the size of post 24. The engagement between post 24 and aperture 46 protects against base 20 and t As further depicted in FIG. 5, magnet holders 23 and 32 respectively support a magnet 50. Any suitable magnet may be used. For example, grade N38 or grade N40 magnets may be used. These magnet grades are well known in the art. Grade N38 and grade N40 magnets have the following properties:

| | Remanence Br | Coercive force Hob | | Maximum Energy Product (BH)max | | Intrinsic Coercive Force Hcj | | Hk(Ho) | Temperature Coefficient (27?) | | Max Working Temp |
|---|---|---|---|---|---|---|---|---|---|---|---|
| Grade | KG 5 | KOe | KA m | MGO 5 | KJ m | KOe | KA m | Hk/Ho | (%/° C.) | (%/° C.) | ° C. |
| N38 | 12.3~12.7 | >10.8 | >860 | 36.5~39.4 | 290~305 | >12 | >960 | >0.8 | <0.13 | <0.6 | 80 |
| N42 | 13~13.6 | >11 | >880 | 40.5~43.4 | 322~345 | >12 | >960 | >0.8 | <0.13 | <0.6 | 80 |

Different magnets having different strengths may be necessary depending upon the type of material used to construct device 10. The magnet strength can be of a value capable of securing base 20 and top 30 proximal each other without having base 20 and top 30 unintentionally move distal each other. The magnet strength can be of a value capable of allowing a user to move base 20 and top 30 distal by using a single hand. Also, the magnet may be covered in stainless steel. Adhesives may be used to secure the magnet.

Figure 6:
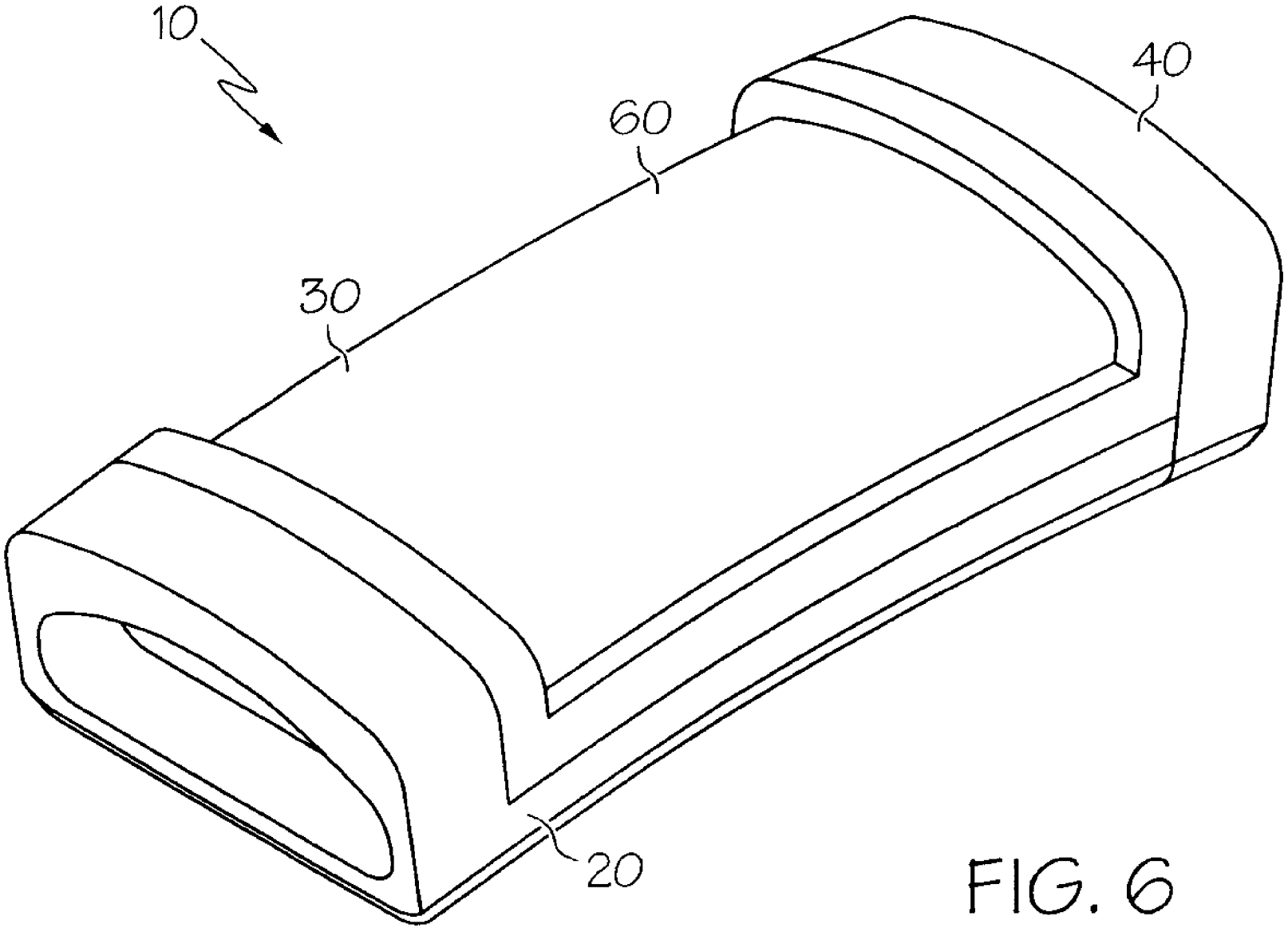
FIG. 6 depicts a perspective view of the device of FIG. 1 in a closed position.

The engagement of base 20 and link 40 depicted in FIG. 5 may be further secured by positioning magnets 50 of base 20 and top 30 proximal each other. Magnets 50 may be positioned proximal each other by positioning base 20 and top 30 proximal each other. FIG. 6 depicts device 10 where base 20 and top 30 are proximal each other. Positioning magnets 50 proximal each other will produce a magnetic force that secures the position of base 20 and top 30 proximal each other. This magnetic force can prevent link 40 from disengaging base 20 because link 40 is located partly between base 20 and top 30.

Any suitable method or device for positioning base 20 and top 30 proximal each other may be used. For example, as shown in FIG. 6, moving base 20 and top 30 proximal each other may be accomplished by rotating the edge of top 30 opposite engagement member 34, to a position proximal the edge of base 20 opposite engagement members 28. In another alternate embodiment not shown, base 20 and top 30 may be moved proximal one another using a latching system, or other suitable device. In this example, top 30 would not rotate to a proximal position relative base 20 but instead may be freely positioned proximal base 20. The latches, or other suitable device, would then secure the engagement of base 20 and top 30.

Figure 7:
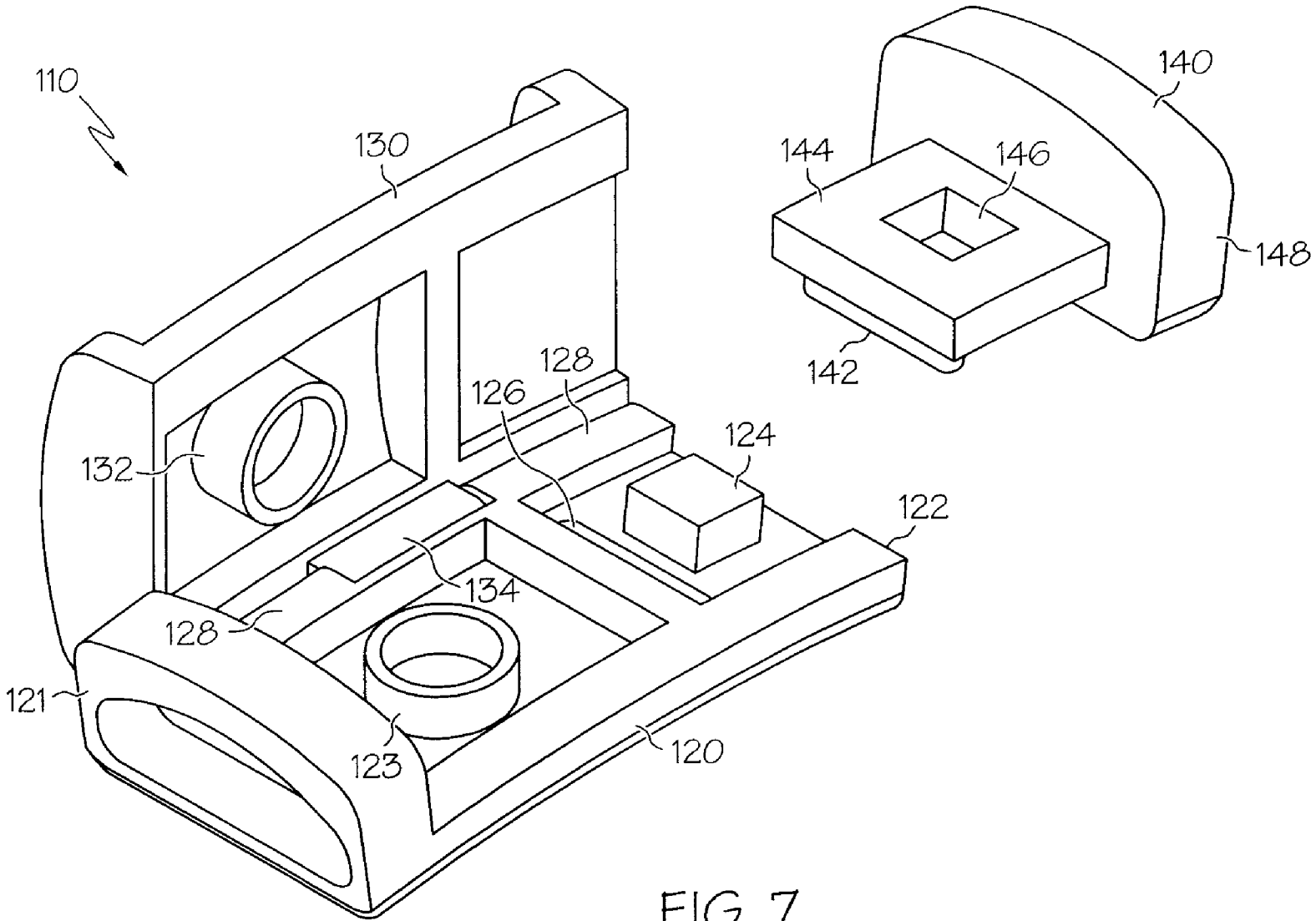
FIG. 7 depicts a perspective view of an exemplary embodiment of a clasp device.
Figure 8:
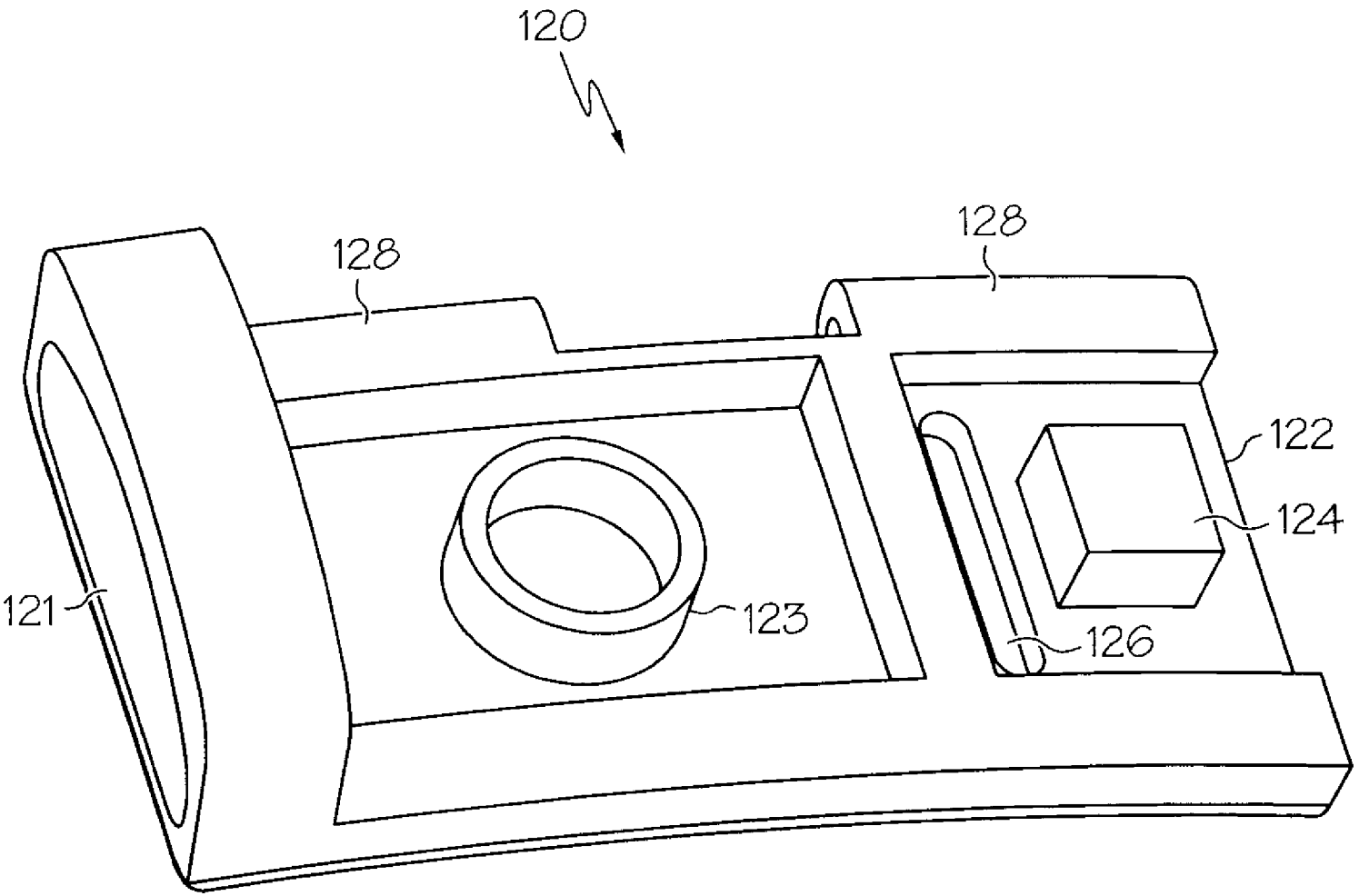
FIG. 8 depicts a perspective view of the base of the device of FIG. 7.
Figure 10:
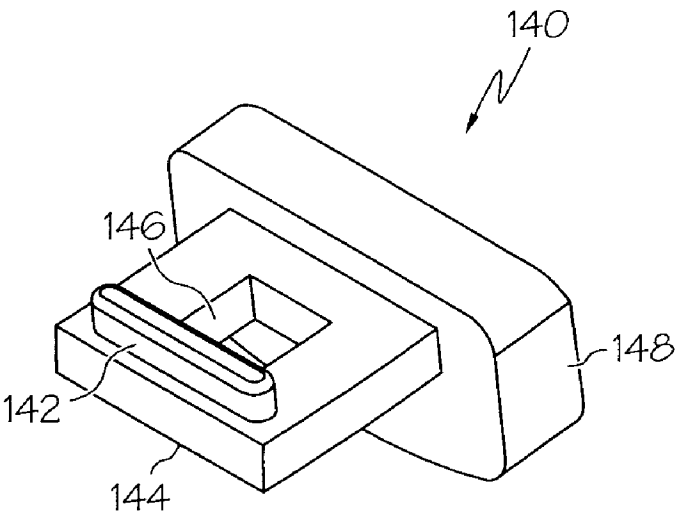
FIG. 10 depicts a perspective view of the link of the device of FIG. 7.
Figure 9:
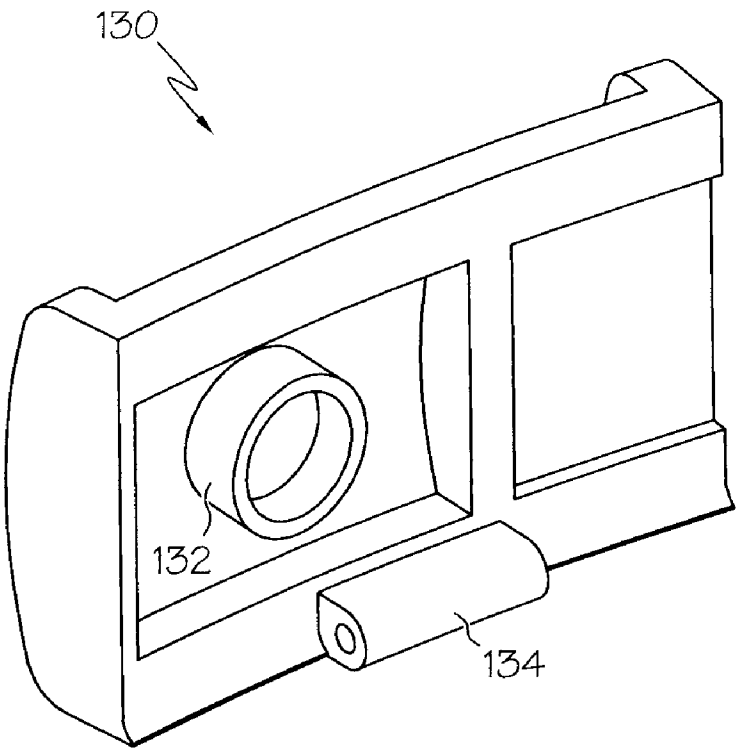
FIG. 9 depicts a perspective view of the top of the device of FIG. 7.

FIG. 7 depicts an exemplary embodiment of a device 110 comprising a base 120, a top 130, and a link 140. As shown in FIG. 8, base 120 comprises a receiving end 121 for receiving any suitable object, and an opposite end 122. A magnet holder 123, a post 124, and at least one cavity 126 are positioned between ends 121 and 122. As shown in FIG. 9, top 130 includes a magnet holder 132 and an engagement member 134. As shown in FIG. 10, link 140 includes an elongated member 142 connected to a plate 144. Any suitable elongated member 142 may be used. In the example depicted in FIG. 11, elongated member 142 is a rectangular bar. Plate 144 includes an aperture 146, and connects to a support member 148 where member 148 may engage at least one end of an ornamental object, or any other suitable object.

Figure 11:
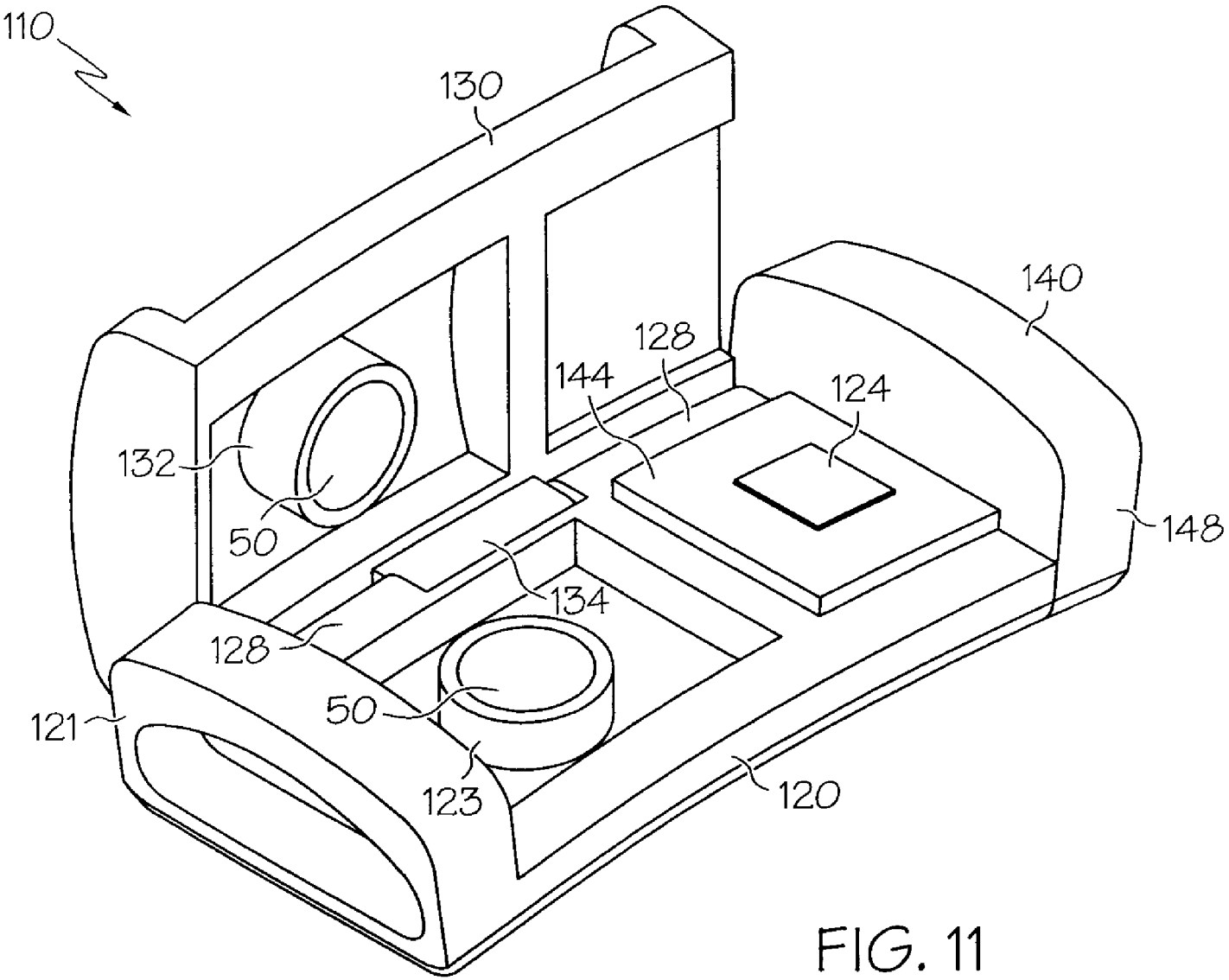
FIG. 11 depicts a perspective view of the device of FIG. 7 in a semi-open position.

FIG. 11 depicts device 110 in a semi-open position where base 120 and link 140 are engaged. Magnet holders 123 and 132 respectively support magnet 50. As depicted, base 120 and link 140 engage one another whereby elongated member 142 and aperture 146 respectively align with and engage cavity 126 and post 124. The engagement produced may be secured by positioning respective magnets 50 in base 120 and top 130 proximal one another. Positioning magnets 50 proximal each other produces a magnetic force securing base 120 and top 130 proximal each other. This magnetic force will then further indirectly secure link 40 positioned partly between base 120 and top 130.

Figure 12:
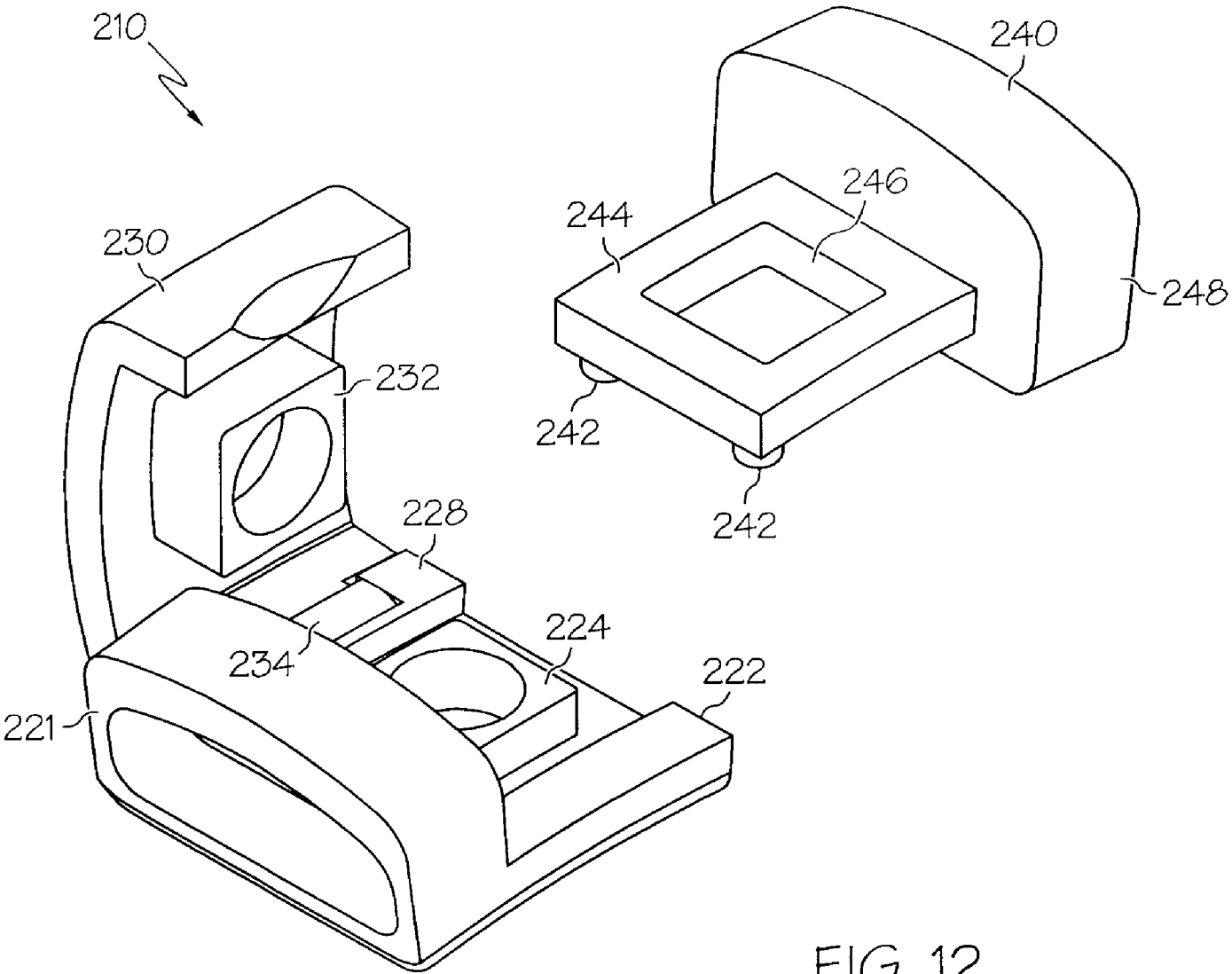
FIG. 12 depicts a perspective view of an exemplary embodiment of a clasp device.
Figure 13:
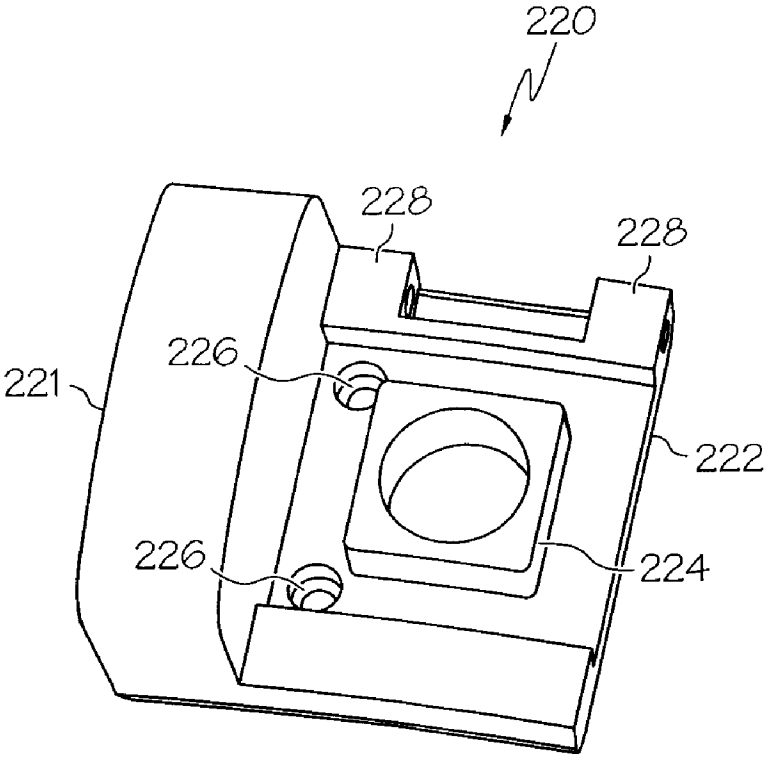
FIG. 13 depicts a perspective view of the base of the device of FIG. 12.

FIG. 12 depicts an exemplary device 210 including a base 220, a top 230, and a link 240. As depicted in FIG. 13, base 220 includes a receiving end 221 and an opposite end 222. Receiving end 221 may engage at least one end of an ornamental object (not shown), or any other suitable object. Base 220 also includes a post 224 positioned between ends 221 and 222. Any suitable post may be used. As depicted in FIG. 13, post 224 has a rectangular shape with a cylindrical hole capable of supporting a magnet 50. Base 220 further includes a plurality of cavities 226 positioned adjacent post 224. Any suitable cavity may be used. For example, as depicted in FIG. 13, cavity 226 has a cylinder shape. Base 220 may further include engagement members 228. An engagement member 228 may be positioned along at least one edge of base 220 to removably engage base 220 and top 230. Any suitable engagement member may be used. For example, as depicted, engagement member 228 is a cylinder with a center bore positioned along an edge of base 220 connecting ends 221 and 222.

Figure 14:
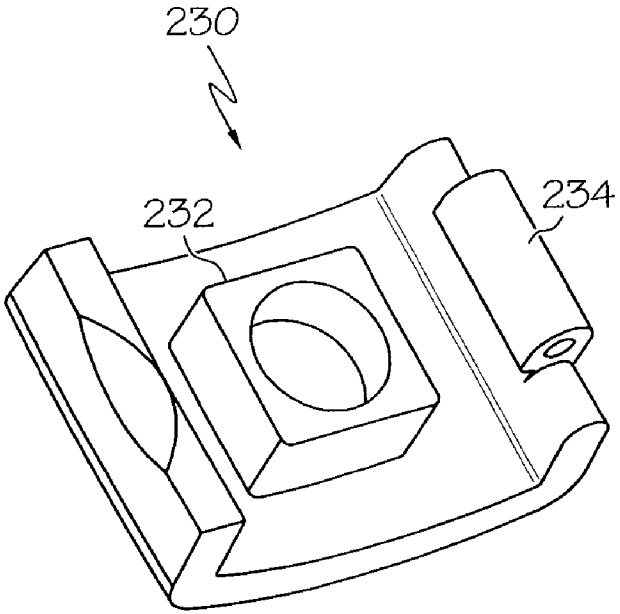
FIG. 14 depicts a perspective view of the top of the device of FIG. 12.

As depicted in FIG. 14, top 230 comprises a magnet holder 232. Any suitable magnet holder may be used. For example, as depicted in FIG. 14, magnet holder 232 has a cylinder shape. Magnet holder 232 may be positioned proximal post 224 when base 220 and top 230 are proximal. Top 230 comprises an engagement member 234. Engagement member 234 may permit top 230 to move proximal base 220. Any suitable engagement member may used.

As depicted in FIG. 12, link 240 includes a plurality of projections 242 extending from a plate 244 comprising aperture 246. Any suitable projection may be used. For example, projection 242 as shown in FIG. 12 is a cylinder shape having a diameter between 0.042 inches and 0.052 inches, and a length between 0.05 inches and 0.06 inches. Plate 244 connects to a support member 248 where support member 248 receives at least one end of an ornamental object, or any other suitable object. Any suitable plate 244 and support member 248 may be used.

Figure 15:
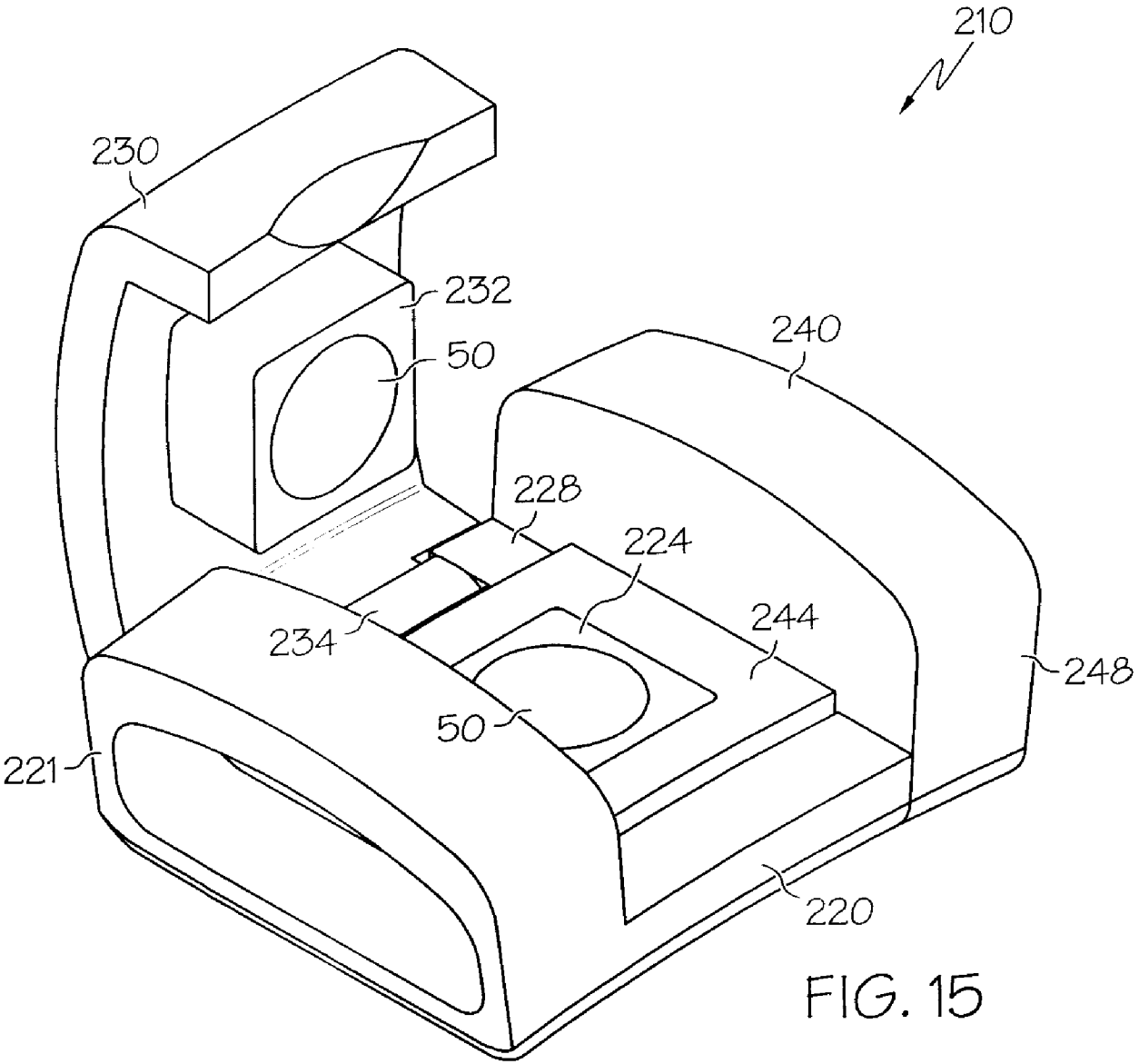
FIG. 15 depicts a perspective view of the device of FIG. 12 in a semi-open position.

As depicted in FIG. 15, link 240 engages base 220 where projections 242 respectively align with and engage cavities 226. As depicted in the example, cavities 226 are a cylinder shape having a diameter 0.002 inches larger than the diameter of projection 242, and a depth at least 0.005 deeper than the length of projection 242. Concurrently, aperture 246 partly surrounds post 224. As shown in the example, post 224 has a square shape having sides about 0.200 inches wide and 0.06 inches tall. Aperture 246 is 0.01 inches to 0.015 inches wider than post 224.

Figure 16:
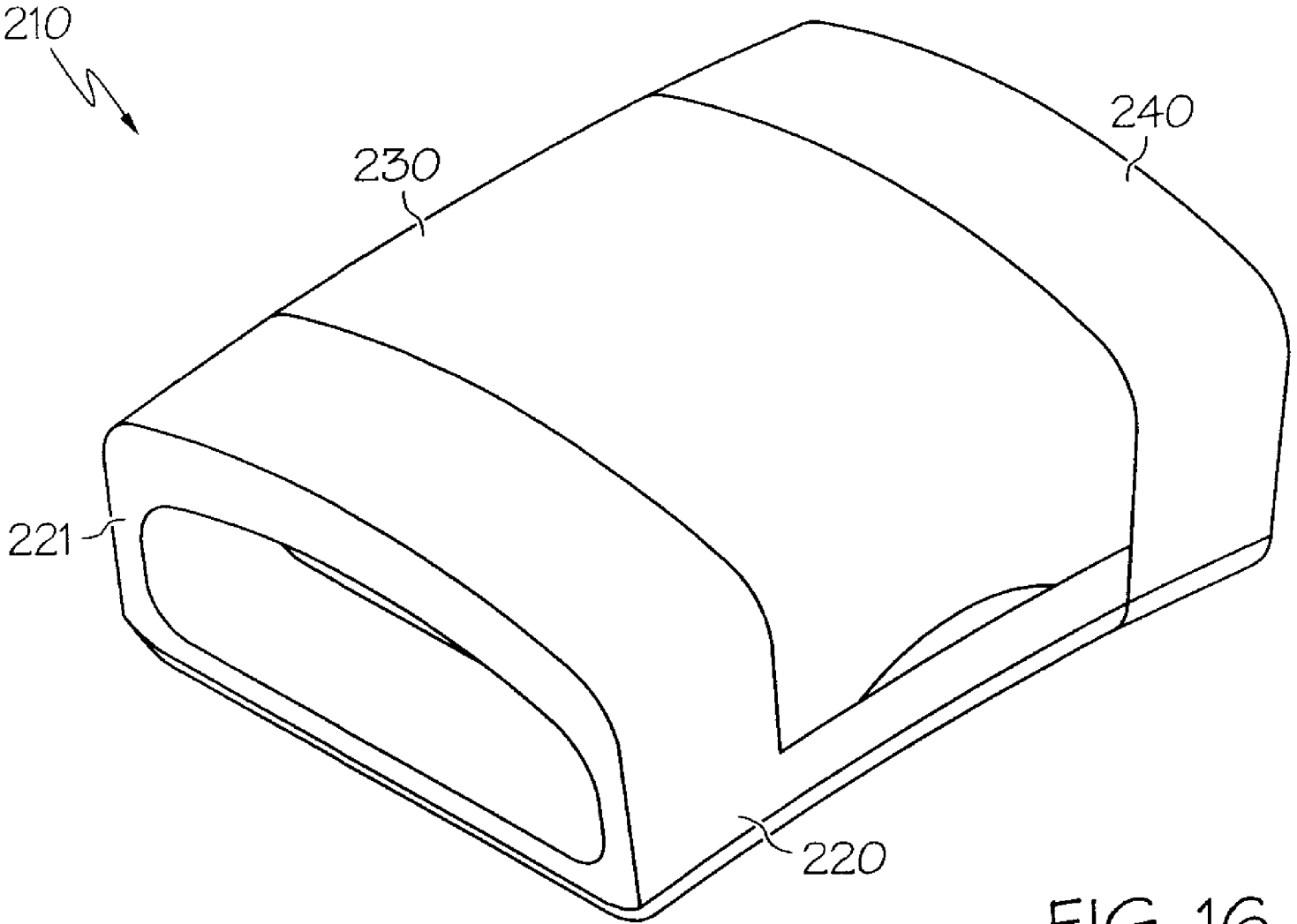
FIG. 16 depicts a perspective view of the device of FIG. 12 in a closed position.

The engagement between link 240 and base 220 may be further secured by moving base 220 and top 230 proximal to each other as depicted in FIG. 16. Moving base 220 and top 230 proximal each other will produce magnetic force by moving post 224 and magnet holder 232 proximal one another. Magnets 50, respectively positioned in post 224 and magnet holder 232, interact to produce magnetic force. Producing this magnetic force secures an engagement between base 220 and top 230 where link 240 is positioned partly between base 220 and top 230. Any suitable device or method may be used to facilitate moving base 220 and link 240 proximal one another. For example, as depicted in FIG. 15, respective engagement members 228 and 234 of base 120 and top 130 may align to permit a hinge pin to engage base 220 and top 230. This hinge connection will permit rotational movement of top 230 to a proximal position relative to base 220.

The foregoing descriptions of embodiments of the application have been presented for purposes of illustration and description. It is not intended to be exhaustive or to limit the application to the precise form disclosed. Obvious modifications or variations are possible in light of the above teachings. The embodiments was chosen and described in order to best illustrate the principles of the application and its practical application to thereby enable one of ordinary skill in the art to best utilize the application in various embodiments and with various modifications as are suited to the particular use contemplated. It is intended that the scope of the application be defined by the claims submitted herewith.

What is claimed is:

1. A clasp comprising:

(a) a base comprising a receiving end and an end opposite the receiving end, wherein a first magnet holder, a post, and at least one cavity are positioned between the receiving end and the opposite end;

(b) a top comprising an end positioned adjacent to the base, an end opposite the base, and a second magnet holder positioned between the adjacent end and the opposite end, wherein the second magnet holder may be proximal the first magnet holder when the top and the base are proximal and wherein the base and top are hingedly connected;

(c) a link comprising at least one projection and an aperture adjacent the projections, wherein the at least one projection is capable of engaging the at least one cavity, wherein the aperture is capable of engaging the post; and (d) a plurality of magnets respectively positioned in the first magnet holder and the second magnet holder.

2. The device of claim 1 wherein the at least one cavity and the post are more adjacent the opposite end of the base than the receiving end.

3. The device of claim 1 wherein the at least one cavity is positioned between the post and the receiving end.

4. The device of claim 1 wherein the first magnet holder is positioned closer to the receiving end than to the end opposite the receiving end.

5. The device of claim 1 wherein the at least one cavity comprises a plurality of cavities positioned in symmetric relationship with the post.

6. The device of claim 1 wherein the at least one projection comprises a plurality of pins and the at least one cavity comprises a plurality of cavities capable of engaging the pins.

7. The device of claim 6 wherein the plurality of pins respectively engage the plurality of cavities and the aperture engages the post, when the link and base are moved proximal.

8. The device of claim 1 wherein the at least one projection comprises an elongated member and the at least one cavity comprises a corresponding elongated cavity.

9. The device of claim 1 wherein the magnets comprise respective stainless steel coatings.

10. The device of claim 1 wherein an adhesive secures the position of the magnet.

11. The device of claim 7 wherein the pins comprise a cylinder shape having a diameter between 0.042 inches and 0.052 inches, and a length between 0.05 inches and 0.06 inches.

12. A clasp comprising:

(a) a base comprising a receiving end, an end opposite the receiving end, a post with a center bore between the receiving end and the opposite end, and a plurality of cavities positioned between the receiving end and the post;

(b) a top comprising an end adjacent the base, an end opposite the base, and a magnet holder positioned between the adjacent end and the opposite end, wherein the magnet holder moves proximal the post when the base and the top are proximal and wherein the base and top are hingedly connected;

(c) a link comprising a plurality of projections and an aperture adjacent the projections; and (d) a plurality of magnets respectively positioned in the post and the magnet holder.

13. The device of claim 12 wherein the magnets comprise respective stainless steel coatings.

14. The device of claim 12 wherein an adhesive secures the position of the magnet.

15. The device of claim 12 wherein the plurality of projections comprise a plurality of pins.

16. The clasp of claim 12 wherein the post is of a square shape being about 0.200 inches wide and about 0.06 inches tall.

17. The clasp of claim 12 wherein the cavities are symmetrically positioned relative the post, wherein the projections are symmetrically positioned relative the aperture, and wherein the size of the aperture is at least large enough to at least partly surround the post.

18. The device of claim 15 wherein the plurality of pins comprise a cylinder shape having a diameter between 0.042 inches and 0.052 inches, and a length between 0.05 inches and 0.06 inches.

* * * * *

UNITED STATES PATENT AND TRADEMARK OFFICE

CERTIFICATE OF CORRECTION

PATENT NO. : 7,849,569 B2
APPLICATION NO. : 12/053018
DATED : December 14, 2010
INVENTOR(S) : Steven Cope It is certified that error appears in the above-identified patent and that said Letters Patent is hereby corrected as shown below:

Column 1, line 18-19, reads "...a top comprising an end position adjacent to the base..."; which should be deleted and replaced with "...a top comprising an end positioned adjacent to the base..."

Signed and Sealed this
Nineteenth Day of July, 2011

David J. Kappos

David J. Kappos
*Director of the United States Patent and Trademark Office*